US011213927B2

(12) United States Patent
Singh et al.

(10) Patent No.: US 11,213,927 B2
(45) Date of Patent: Jan. 4, 2022

(54) CMP POLISHING PAD CONDITIONER

(71) Applicants: SINMAT, INC., Gainesville, FL (US); UNIVERSITY OF FLORIDA RESEARCH FOUNDATION, INC., Gainesville, FL (US)

(72) Inventors: Rajiv K. Singh, Newberry, FL (US); Deepika Singh, Newberry, FL (US)

(73) Assignee: ENTREGIS, INC., Billerica, MA (US)

( * ) Notice: Subject to any disclaimer, the term of this patent is extended or adjusted under 35 U.S.C. 154(b) by 389 days.

(21) Appl. No.: 16/233,943

(22) Filed: Dec. 27, 2018

(65) Prior Publication Data

US 2019/0202028 A1 Jul. 4, 2019

Related U.S. Application Data

(60) Provisional application No. 62/611,317, filed on Dec. 28, 2017.

(51) Int. Cl.

| | |
|---|---|
| ***B24B 53/017*** | (2012.01) |
| ***B24B 53/12*** | (2006.01) |
| ***B24B 53/013*** | (2006.01) |
| ***B24B 53/047*** | (2006.01) |
| ***B24B 37/04*** | (2012.01) |

(52) U.S. Cl.

CPC ..... *B24B 53/017* (2013.01); *B24B 37/04* (2013.01); *B24B 37/042* (2013.01); *B24B 37/044* (2013.01); *B24B 53/013* (2013.01); *B24B 53/047* (2013.01); *B24B 53/12* (2013.01)

(58) Field of Classification Search

CPC ..... B24B 53/17; B24B 37/04; B24B 37/042; B24B 37/044; B24B 37/10; B24B 37/20; B24B 37/53; B24B 37/007; B24B 37/013; B24B 37/017; B24B 37/02; B24B 37/047;

(Continued)

(56) References Cited

U.S. PATENT DOCUMENTS 6,227,948 B1 5/2001 Khoury et al.
6,884,155 B2 * 4/2005 Sung ..... B24B 53/017 451/443

(Continued)

FOREIGN PATENT DOCUMENTS

JP 2004-320764 * 11/2004 ..... B24B 53/12

*Primary Examiner* — Eileen P Morgan

(74) *Attorney, Agent, or Firm* — Entregis, Inc.

(57) ABSTRACT

A method of processing chemical mechanical polishing (CMP) pad conditioners includes providing the CMP pad conditioner including conditioner substrate that is a metal, ceramic or a metal-ceramic material with a plurality of hard conditioner particles with a Vickers hardness greater than 3,000 Kg/mm$^2$ bonded to a top surface of the conditioner substrate, and a slurry including an aqueous medium and a plurality of hard slurry particles having a hardness greater than 3,000 Kg/mm$^2$. The surface of the pad conditioner is polished in a CMP apparatus using a polishing pad. After the polishing each conditioner particle has at least one exposed facet, and the plurality of hard conditioner particles have a maximum average protrusion-to-protrusion flatness (PPF) difference of 20 microns, and a sharpest edge measured by a value of a cutting edge radius (CER) that lies at an edge of the facet for at least 80% of the facets.

9 Claims, 11 Drawing Sheets

(58) Field of Classification Search
CPC ..... B24B 37/053; B24B 37/06; B24B 37/062; B24B 37/065; B24B 37/12; B24D 3/001
USPC ..... 451/36, 41, 56, 59, 443
See application file for complete search history.

(56) References Cited

U.S. PATENT DOCUMENTS

| | | | | |
|---|---|---|---|---|
| 7,201,645 | B2 * | 4/2007 | Sung | B24B 53/017 451/443 |
| 7,651,386 | B2 * | 1/2010 | Sung | B24B 7/228 451/56 |
| 9,022,840 | B2 * | 5/2015 | Dinh-Ngoc | B24B 53/017 451/443 |
| 9,259,819 | B2 * | 2/2016 | Singh | B24B 37/044 |
| 2001/0024933 | A1 * | 9/2001 | Sachan | C09G 1/02 451/41 |
| 2004/0242121 | A1 * | 12/2004 | Hirokawa | B24B 37/205 451/5 |
| 2007/0167117 | A1 * | 7/2007 | Moon | B24B 53/017 451/72 |
| 2009/0325472 | A1 * | 12/2009 | Wu | B24B 37/205 451/443 |
| 2010/0261419 | A1 * | 10/2010 | Sung | B24D 18/0054 451/443 |
| 2013/0316629 | A1 * | 11/2013 | Sung | B24B 53/12 451/443 |
| 2014/0124793 | A1 * | 5/2014 | Singh | C09G 1/02 257/77 |
| 2015/0087212 | A1 * | 3/2015 | Doering | B24B 53/017 451/443 |
| 2016/0121454 | A1 | 5/2016 | Song et al. | |

* cited by examiner

| LABEL | VALUE | UNITS |
|---|---|---|
| AVERAGE | 0 | nm |
| Ra | 0.102 | µm |
| Rp | 0.991 | µm |
| Rq | 0.162 | µm |
| Rt | 2.545 | µm |
| Rv | -1.554 | µm |

| LABEL | VALUE | UNITS |
|---|---|---|
| AVERAGE | 0 | nm |
| Ra | 42.782 | nm |
| Rp | 0.2 | µm |
| Rq | 54.77 | nm |
| Rt | 0.418 | µm |
| Rv | -0.218 | µm |

CMP POLISHING PAD CONDITIONER

CROSS REFERENCE TO RELATED APPLICATIONS

This application claims the benefit of Provisional Application Ser. No. 62/611,317 entitled "CMP POLISHING PAD CONDITIONER", filed Dec. 28, 2017, which is herein incorporated by reference in its entirety.

FIELD

Disclosed embodiments relate to pad conditioners that condition polishing pads used for chemical mechanical polishing (CMP).

BACKGROUND

CMP polishing pad conditioners (CMP pad conditioners) are used extensively in CMP processes to regenerate the surface of the polishing pad, where the polishing pad usually comprises a polymer material. CMP pad conditioners generally comprise a metal substrate including a plurality of surface protrusions secured thereon.

During the production polishing process applied to product wafers, due to the continuous tribological interaction of the CMP polishing pad, the slurry which typically includes abrasive particles, and the substrate (e.g., wafer) surface being polished, the CMP polishing pad becomes smoother and may acquire a glazed finish. This can lead to variations in the CMP removal rate with time, and introduce other variabilities in the polishing process. To address this performance degradation of the polishing pad, a CMP pad conditioner comprising diamond or other hard material protruding surface that is attached to a pad conditioner substrate which is generally a metal is rubbed against the CMP polishing pad.

The protruding hard materials (such as diamond) on the CMP pad conditioner surface are generally either made by physically attaching a plurality of diamond particles or other hard particles onto the surface of a conditioner substrate comprising a metal, or by growing a polycrystalline diamond film or other hard material film (such as carbide, nitrides, oxides or a combination of these) on the conditioner substrate, such as by chemical vapor deposition or physical vapor deposition to form the film on a patterned conditioner substrate or on an unpatterned conditioner substrate. A sinter step can be used after the hard material layer deposition. The protruding hard material particles become mechanically and/or chemically bonded to a top surface of the conditioner substrate.

For physical attachment of the diamond or other hard particles onto the conditioner substrate, the size of the diamond particles or other hard particles can vary from 10 microns to 5 mm, while the surface density of the diamond particles or other hard particles can vary from 10 per $cm^2$ to 100,000 per $cm^2$. The average distance between the protruding particles or between the patterned protruding surfaces can vary from 1 micron to 10 mm. The height of the attached hard particles or the patterned hard surfaces can vary from 1 micron to 3 mm. In the case of a diamond film or other hard material film deposited on a patterned area, the area of the protrusions (measured either from the base or from the top of the protrusions) can vary from 1 micron to 100 $mm^2$.

For the patterned conditioner substrate arrangement, the pattern inherently provides roughness. Regarding the unpatterned CMP pad conditioner arrangement, the CMP pad conditioner can have a blanket rough film of a hard material such as a diamond layer on a metal or ceramic conditioner substrate, where the diamond layer provides protruding diamond particles. Despite being unpatterned, a rough surface is possible even if the substrate is not patterned because, for example, by depositing a diamond layer by chemical vapor deposition (CVD) that has a very rough morphology, with the roughness increasing with the thickness of the diamond film. For example the roughness (such as quantified by its Ra, being the arithmetic average of the roughness profile) of the as-grown diamond film by CVD can range from 1 nm to 200 μm, typically being >0.1 μm.

Pad conditioning is a process that is performed by a CMP pad conditioner on the polishing pad used for polishing production wafers. During a typical CMP wafer polishing process, a polymeric polishing pad becomes glazed (i.e., loses it roughness) due to tribological action of the polishing pad with the production wafers (substrates). This can lead to reduction in CMP removal rate and/or uniformity of the wafer polishing process. Accordingly, the roughness of the polishing pad is periodically restored using a CMP pad conditioner. The CMP pad conditioner is rubbed against the polishing pad with a slurry either after the production lot polishing run, or simultaneously during the production polishing run using a mechanical attachment.

The tribological action during pad conditioning due to rubbing action between the polishing pad and CMP pad conditioner generally causes scratches on the surface of the polishing pad. This scratching process beneficially increases the roughness of the polishing pad and decreases the time-based variability of the wafer polishing process. However, with time the protruding diamond surfaces or the unpatterned rough surface of the CMP conditioner pad can become dulled and blunted due to the chemical mechanical action of the slurry and the polishing pad so that its polishing pad reconditioning ability may be degraded. Once this occurs the CMP pad conditioner does not work effectively for the pad conditioning process it was designed for. Conventionally the CMP pad conditioner is then replaced when its surface becomes dull and blunted.

SUMMARY

This Summary briefly indicates the nature and substance of this Disclosure. It is submitted with the understanding that it will not be used to interpret or limit the scope or meaning of the claims.

Disclosed embodiments include a CMP-based method for forming or for recycling CMP pad conditioners after production use which results in disclosed CMP pad conditioners having even more useful surface features for pad conditioning as compared to the original CMP pad conditioner in its initial as-manufactured (new) condition. The surface of the CMP pad conditioner after production use is polished in a CMP apparatus in a process referred to herein as a 'conditioner reconditioning step'. A method of processing a CMP pad conditioner includes providing a CMP pad conditioner, and a CMP apparatus including a slurry and a polishing pad. The CMP pad conditioner includes a substrate referred to herein as a 'conditioner substrate' having a plurality of hard conditioner particles thereon that have a Vickers hardness greater than 3,000 $Kg/mm^2$ bonded to a top surface of the conditioner substrate, or a hard film with a Vickers Hardness greater than 3,000 $Kg/mm^2$ on a conditioner substrate that is a patterned substrate. The conditioner substrate comprises a metal, ceramic, or a metal-ceramic composite material. The slurry includes an aqueous medium and a plurality of hard slurry particles having a hardness greater than 3,000 $Kg/mm^2$.

The polishing pad generally comprises a metal such as steel, copper or brass, a ceramic material such as silica, or alumina, with Vickers hardness greater than 50 $Kg/mm^2$. After the disclosed polishing the surface of the CMP pad conditioner, the plurality of hard conditioner particles have an average protrusion-to-protrusion flatness (PPF) as defined herein measured either by optical or mechanical profilometry of a maximum of 20 microns, and a sharpest edge measured by a value of a cutting edge radius (CER) that lies within 5 micron from the protrusion edge or within 20% of the average dimension of the protrusion from the edge for at least 80% of the protrusions. The within protrusion flatness (WIPF) is at least 20 microns or lower, where the WIPF as defined herein is the height difference from any point within 2 microns from the edge of the protrusion to the highest point in the protrusion, which is generally 5 microns or less.

After the reconditioning polishing step when the CMP pad conditioner comprises of a polycrystalline diamond surface, the surface roughness also has a unique signature which has at least 80 percent of the tallest grains possessing an orientation which is within 20 degrees from the (111) orientation, while at least 50 percent of the shortest grains comprise grains which are within 20 degrees from the (100) and (110) grain in the valley regions. The tallest grains are defined herein by grains whose height lie on the top 20 percent of the peak-valley (PV) range measured by optical height profilometry or other suitable method, while the shortest grains are defined herein by grains that lie in a bottom 20% of the PV range when measured by optical profilometry methods or other methods. In contrast, the non-reconditioned surfaces show a random orientation of the grains or have a surface where the plurality of the tallest grains do not comprise the (111) orientation.

BRIEF DESCRIPTION OF THE DRAWINGS

FIG. 3A shows that the sharpest edge of the protrusion is formed by the intersection of the horizontal and vertical planes and is at protrusion edges, thus being located within 5 microns from a protrusion edge. In the standard CMP pad conditioner shown in FIG. 3B, the sharpest surface does not lie at or near an edge of the protrusion. Also the sharpest surface shown in FIG. 3B is not formed by the intersection of the horizontal and vertical planes.

DETAILED DESCRIPTION

Figure 1:
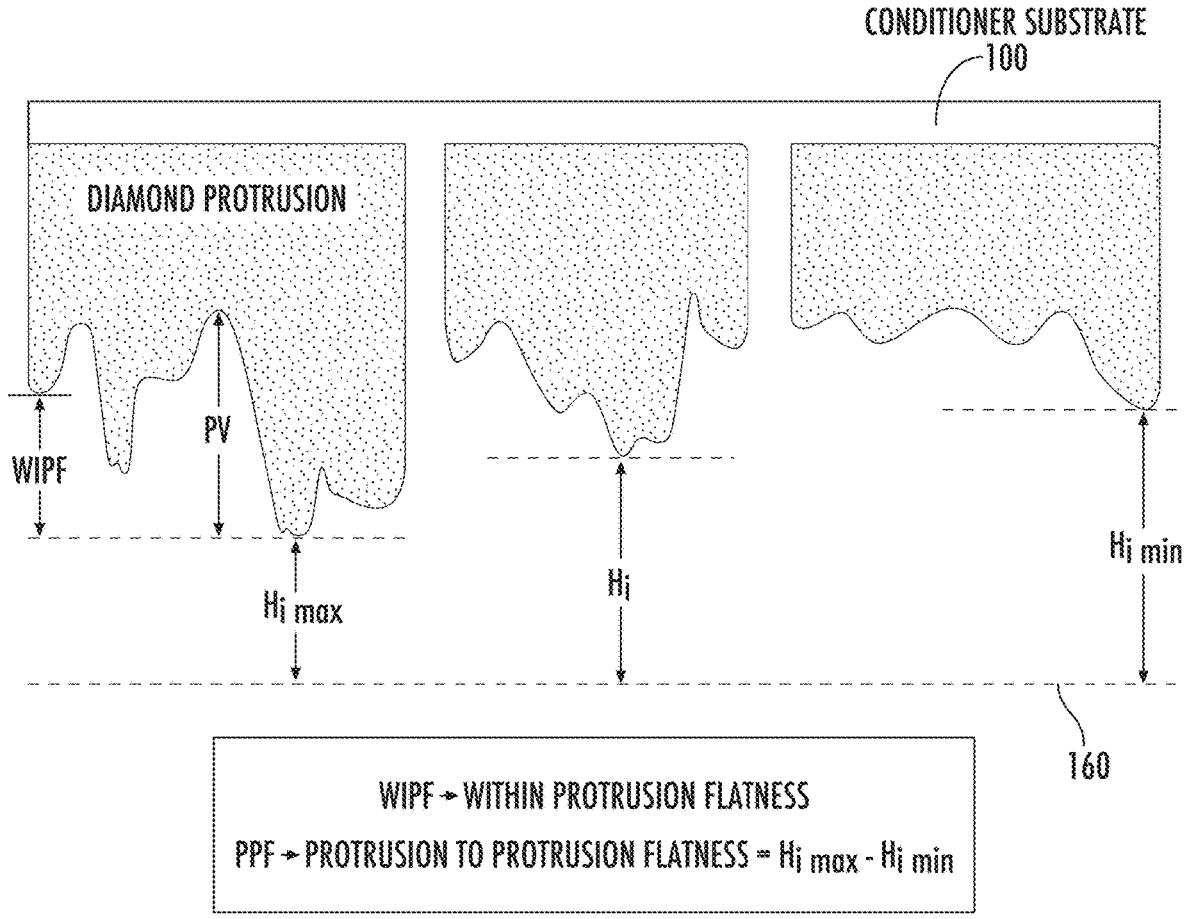
FIG. 1 is a schematic diagram showing surface features for different shaped diamond protrusions bonded on to a conditioner substrate that includes a showing of how protrusion flatness parameters, PPF and WIPF, are defined herein.

Embodiments of the invention are described with reference to the attached figures, wherein like reference numerals are used throughout the figures to designate similar or equivalent elements. The figures are not drawn to scale and they are provided merely to illustrate certain features. Several aspects of this Disclosure are described below with reference to example applications for illustration.

It should be understood that numerous specific details, relationships, and methods are set forth to provide a full understanding of the subject matter in this Disclosure. One having ordinary skill in the relevant art, however, will readily recognize that embodiments of the invention can be practiced without one or more of the specific details or with other methods. In other instances, well-known structures or operations are not shown in detail to avoid obscuring subject matter. Embodiments of the invention are not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Disclosed embodiments include methods to process to fabricate or to recondition after production use in a conditioner reconditioning step the surface of a CMP pad conditioner that comprises protruding hard material particles such as diamond particles bonded (mechanically bonded and/or chemical bonded) onto a top surface of a conditioner substrate that is generally in the form of a plate. The conditioner substrate comprises a metal, ceramic or metal-ceramic composite material, which can be a patterned, or an unpatterned conditioner substrate. The CMP pad conditioner in disclosed methods is generally polished by a conventional CMP apparatus using a slurry containing hard slurry particles, such as diamond particles in one example.

A disclosed CMP pad conditioner typically comprises a conditioner substrate having a surface embedded with diamond particles or other hard material(s) with a Vickers hardness greater than 3,000 Kg/mm$^2$. The diamond particles typically have a size ranging from 1 micron to 5,000 microns in the maximum or minimum dimensions with the surface area of the protruding surfaces varying from 0.01% surface coverage of the total area of conditioner to 100% of total area of the CMP pad conditioner. As described above, the protruding surface of the CMP pad conditioner can also be formed by diamond or hard films by thin film deposition methods in which an unpatterned or patterned surface of a conditioner substrate material such a metal, metal alloy, ceramic or metal-ceramic, on which there is a film of a hard material with Vickers hardness greater than 3,000 g/mm$^2$ thereon. The diamond particles can have any crystallographic orientation with orientation ranging from any angle from the (111), (100) or (110) crystallographic planes.

The diamond film or other hard material film with hardness greater than 3,000 Kg/mm$^2$ on the pad conditioner surface is generally a single layer having a thickness of 0.5 microns or greater (e.g., 0.5 μm to 400 μm). For mechanical attachment of the diamond or other hard particles, the size of the diamond particles can vary from 1 micron to 5 mm, while the surface density of the hard particle can vary from 10 per cm$^2$ to 100,000 per cm$^2$. The average distance between the protruding particles can vary from 1 micron to 10 mm. The height of the hard particles can vary from 1 micron to 3 mm. In the case of a diamond film on a patterned conditioner substrate protruding surface, the height for the protrusions can vary from 1 micron to 10,000 micron, the area of the protrusions can vary from 1 μm$^2$ to 100 mm$^2$.

Examples of hard particle surfaces for the slurry used in disclosed methods including in the conditioner reconditioning step have a Vickers hardness of at least 3,000 Kg/mm$^2$ include boron nitride, boron carbide, silicon carbide, alumina, diamond, oxides, certain nitrides and carbides of metal, or mixtures of these materials. The average size of the hard particles for the slurry can vary from 5 nm to 5,000 μms, typically being 1 micron to 5,000 μms. The concentration of hard particles in the slurry can vary from 0.1 weight percent to 80 weight percent. Optionally the polishing slurry can contain a mixture of diamond particles and at least one other particle material such as silica, alumina, or titania, or particles with a hardness less than 2,000 Kg/mm$^2$.

The CMP apparatus can have a CMP polishing pad comprising a polymer, a ceramic, or a metal. Examples of polymeric pads include polyurethane, PVC, and polycarbonate, where the Shore A or Shore D hardness of the polishing pad can vary from 5 to 100. Examples of metal CMP polishing pads include steel, cast iron, copper, tin, and aluminum alloys containing one of these metals. Examples of ceramic CMP polishing pads include alumina, glass, oxides, nitride, carbides of metals and their mixtures thereof. The Vickers hardness of the metal polishing pads can vary from 50 Kg/mm$^2$ to 2,000 Kg/mm$^2$, while the Vickers hardness of ceramic pads can vary from 100 Kg/mm$^2$ to 6,000 Kg/mm$^2$.

In another embodiment the CMP conditioning pad can have a stacked multilayer structure comprising at least two layers. For example, the stack can include a top layer of a metal or ceramic with hardness between 50 Kg/mm$^2$ to 10,000 kg/mm$^2$ or a polymeric material with Shore A hardness greater than 50, and at least 1 layer beneath the top layer with a softer surface as compared to the top layer. The thickness of the top layer can be from 0.1 micron to 5 mm, while the bottom layer's thickness can be from 0.1 mm to 5 cm. Examples of top layers include diamond, steel, cast iron, copper, brass, tin, and alumina.

The slurry can contain one or more types of particles with a pH ranging from 1 to 13 with a typical pH range in the acidic range of 2 to 6, a neutral including range from 6 to 8.5, or alkaline range from 9.0 to 12.5. Optionally the slurry can also contain additives such as oxidizers, surfactants, pH modifiers. The polishing process on the pad conditioner can be conducted at nominal pressures ranging from 0.01 psi to 1000 psi with a typical range from 1 psi to 100 psi, or 2 psi to 20 psi, where the polishing area is computed as the total of both protruded and non-protruded areas. The relative velocity between the CMP pad conditioner and the polishing pad performing the CMP pad conditioner polishing can range from 0.01 m/sec to 100 m/sec, with a typical range from 0.5 m/s to 10 m/s or 0.5 m/s to 2 m/s. The pressure during the pad conditioner polishing can range from 0.5 Psi to 100 psi, and the table speed can range from 0.5 rpm to 600 rpm.

After disclosed CMP pad conditioner polishing during the conditioner reconditioning step, new features in the protrusions on the CMP pad conditioner surface are observed, where the protrusion's surfaces become much flatter and possess a sharpest edge typically within 5 microns from the edge of the protrusion. FIG. 1 is a schematic diagram showing surface features for different shaped diamond protrusions bonded onto a conditioner substrate 100 that shows how several protrusion flatness parameters are defined herein. For each protrusion shown the highest (tallest) peak feature is labelled as Hi, which is measured from an imaginary flat plane 160 that is opposite the conditioner substrate 100. The number of protrusions for this flatness measurement can vary from 2 to 200. $H_i$ max refers to the peak closest to the imaginary plane 160, while $H_i$ min refers to the peak farthest away from the imaginary plane 160. PV refers to the peak-valley of the roughness of the protrusions. WIPF as noted above refers to the Within Protrusion Flatness which is the difference in heights between the highest and lowest peak within the protrusion, and as noted above PPF refers to a Protrusion to Protrusion Flatness difference which is the maximum difference of $H_i$ max among different protrusions for the number of protrusions in consideration for this flatness measurement (which as noted above can vary from 2 to 200 protrusions).

After the conditioner reconditioning step, the WIPF is less than 200 microns, such as less than 100 microns, less than 50 microns, less than 10 microns, or less than 1 micron. The PPF is less than 200 microns, such as less than 50 microns, less than 10 microns, or less than 1 micron. The PPF based on 5 nearest neighbors is less than 200, such as less than 50 microns, less than 10 microns, or less than 1 micron. The PPF based on 20 nearest neighbors is less than 200 micron such as less than 50 microns, less than 10 microns, or less than 1 micron. The PPF based on 100 nearest neighbors is less than 200 micron such as less than 50 microns, less than 10 microns, or less than 1 micron. The standard deviation of WIPF of 2 or more nearest protrusions neighbors decreases by at least 10 percent, such as at least 20% or at least 50%, as compared to prior to the pad conditioner reconditioning process. The PFF among 5 or more nearest neighbor protrusions decreases by at least 10 percent, such as at least 20% or at least 50%, as compared to prior to the CMP pad conditioner reconditioning process.

The CER of the edges formed between the horizontal surface and the vertical surface of the respective protrusions for the CMP pad conditioner also decrease after the reconditioning process. See the CER shown in FIG. 2B described below. The smaller the value of CER, the sharper the cutting property of the protrusion. The CER value is defined herein as the length of the straight line formed by joining the point where the vertical and the horizontal surface from a single protrusion deviate from a straight line when viewed at a magnification of at least 1,000×. The CER can be measured between the flat, horizontal polished face of the protrusion and the vertical-like (non-horizontal) faces of the protrusion, or between two non-horizontal faces of the protrusion.

After disclosed CMP pad conditioner polishing using a diamond particle based slurry during the conditioner reconditioning step, the CER value for protrusions decreases by at least 10%, such as decreasing by at least 30% or 50% or 80%. The average CER value from 5 nearest neighboring protrusions decreases by at least 10%, such as 30% or 50% after the reconditioning step (compared to before the reconditioning step). After the reconditioning step, the CER values measured between the vertical and horizontal surface is less than 200 microns, such as below 100 microns, below 50 microns, below 10 microns, below 5 microns, or 1 below micron. The wedge angle shown in FIG. 2B described below after the reconditioning process can vary from 20 to 120 degrees, such as between 75 to 100 degrees. After reconditioning of the CMP pad conditioner the surface of the CMP pad conditioner becomes faceted with at least one facet and thus sharper (not rounded) when viewed by an optical microscope with a magnification of at least 100. The number of faceted corner edges after the reconditioning step is at least one, such as being at least 2, or at least 4.

Figure 2A:
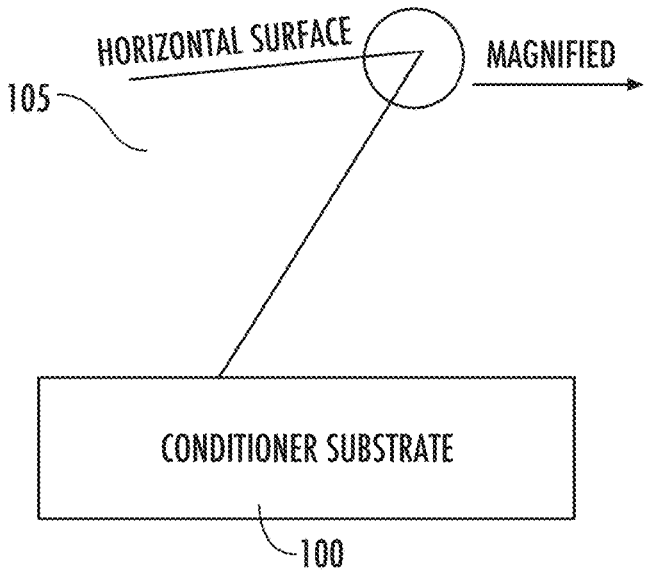
FIG. 2A shows a depiction of an edge of a diamond particle bonded on a pad conditioning substrate surface with no magnification after disclosed pad conditioning.
Figure 2B:
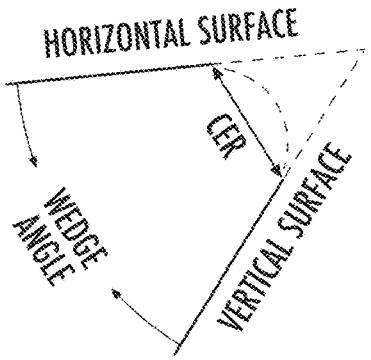
FIG. 2B shows a depiction of the CER and the wedge angle for this diamond particle with a magnification of about 1,000×.

FIG. 2A shows a depiction of an edge of a diamond particle 105 bonded on conditioning substrate 100 with no magnification after disclosed pad conditioning, and FIG. 2B shows a depiction of the CER and wedge angle for this diamond particle 105 with a magnification of about 1,000×.

Another feature of the disclosed CMP pad conditioner reconditioning process is that the sharpest edge of the protrusions (thus lowest value of CER) is generally at the edge of the protrusions. This is in contrast to conventional protrusions on the surfaces of pad conditioners where the sharpest edge (thus the lowest CER value) at the edge of the protrusions will be at a lower percentage. After the disclosed pad conditioner polishing step, >80% such as 90%, 95% or 99% of the lowest CER values for at least 10 nearest neighbor protrusions, such as 10 to 100 nearest neighbor protrusions, lie within 5 microns or within 20% of average dimension of the protrusion, whichever is smaller from the edge of the protrusion. This means that if one examines 100 protrusions in the conditioned CMP pad conditioner, then at least for 80 protrusions of average size of 100 microns, the sharpest edge of the protrusion will lie within 5 microns from the edge. In contrast in a conventional non-reconditioned conditioner pad, <80% such as 65%, less or 50%, or less than 20% of the lowest CER value occurs at the edge of the protrusions when the number of protrusions for the measurement is at least 10. This means that if one examines 100 protrusions in a conventional CMP pad conditioner, then at least for 80 protrusions of average size of 100 microns, the sharpest edge of the protrusion will lie at least 5 microns away from the protrusion edge.

Figure 3A:
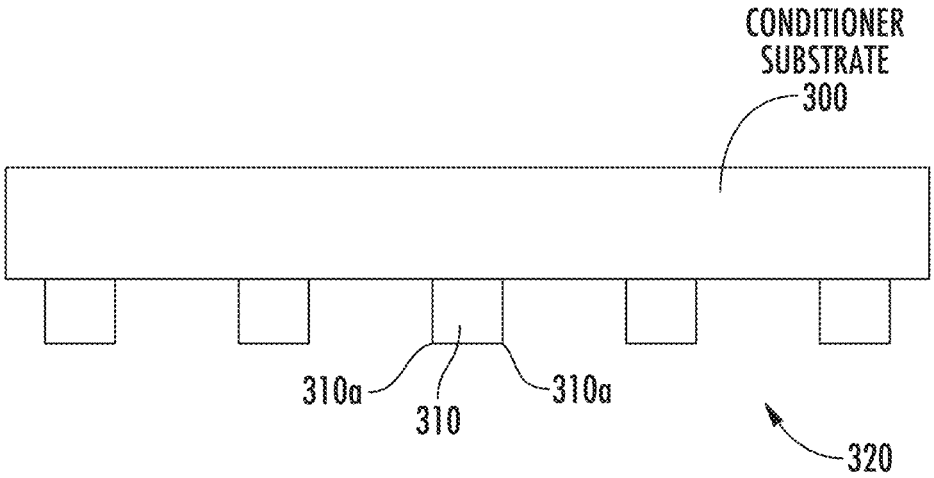
FIG. 3A is a schematic diagram of a disclosed pad conditioner comprising diamond or other hard material protrusions on a metal, ceramic or metal-ceramic composite conditioner substrate which is compared to a standard diamond protrusion-based conditioner shown in FIG. 3B.
Figure 3B:
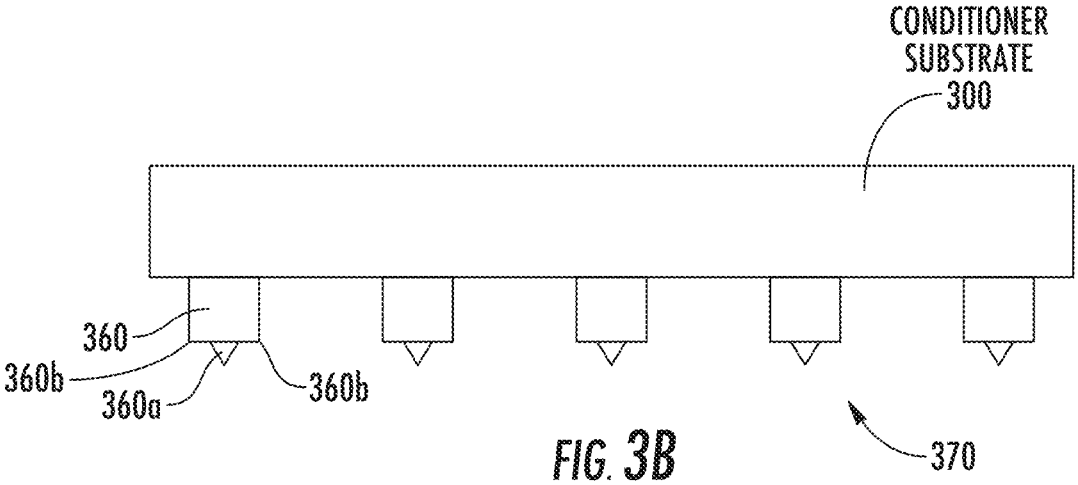
FIG. 3B (PRIOR ART)

FIGS. 3A and 3B shows how a disclosed CMP pad conditioner 320 shown in FIG. 3A differs from a conventional CMP pad conditioner 370 as shown in FIG. 3B in two important aspects. The conditioner substrate in FIGS. 3A and 3B is shown as 300. The sharpest edges of the protrusions 310 for the disclosed CMP pad conditioner 320 as shown in FIG. 3A lies at the protrusion edges 310*a*, while for the conventional CMP pad conditioner 370 as shown in FIG. 3B the sharpest edge of the protrusion 360 shown as 360*a* lies between the protrusion edges 360*b*. Also, the sharpest edge 310*a* of the protrusion 310 for the disclosed CMP pad conditioner 320 is formed from the intersection of the vertical and horizontal planes, whereas for the conventional CMP pad conditioner 370 the sharpest edge 360*a* of the protrusion 360 is formed by the intersection of two non-horizontal planes. As noted above, the horizontal plane is a plane that is within 20 degrees parallel to the bottom surface of the conditioner substrate 300 to which the protrusions are attached.

Figure 4:
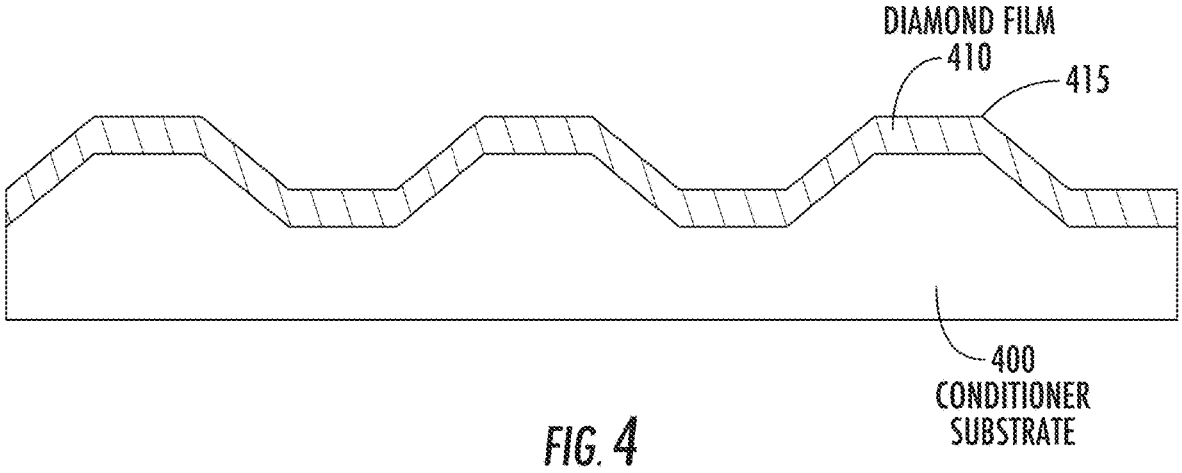
FIG. 4 shows a schematic diagram of patterned conditioner substrate with a surface film of diamond thereon after disclosed CMP pad conditioner reconditioning. The thickness of the diamond film can vary from 0.1 micron to 200 microns, the surface roughness (Ra) of the horizontal surface is generally less than 200 nm, and the CER value at the edge is 5 microns or less.

FIG. 4 shows a schematic diagram of patterned conditioner substrate 400 with a disclosed diamond surface film 410 thereon after disclosed CMP pad conditioner reconditioning. The thickness of the diamond film 410 can vary from 0.1 micron to 200 micron, and the surface roughness (Ra) of the horizontal surface of the diamond film 410 is generally less than 200 nm. The CER value at the pattern edge 415 of the diamond film 410 is 5 microns or less.

The CMP pad conditioner reconditioning process can alter the surface roughness of polycrystalline diamond films and diamond protrusions. After the CMP pad conditioner reconditioning step the average Ra value is at least 0.15 micron, such as at least 0.2 microns, or at least 1 micron. After the conditioner reconditioning step the Ra value generally increases by at least 10%, such as at least 20%, compared to prior to the reconditioning process.

Another significant aspect of the disclosed CMP pad conditioner reconditioning process for pad conditioners having polycrystalline diamond films is the change in surface structure of the polycrystalline diamond films after the reconditioning process. Such polycrystalline diamond films as described above can be applied on both patterned and unpatterned conditioner substrate surfaces. One aspect of surface roughness in the polycrystalline diamond films is constituted by different grains which may have different heights. For example, the average heights of the (100) grains and (111) grain may not be the same contributing to the surface roughness. As these diamond films are generally deposited by a chemical vapor deposition (CVD) process, the highest heights grains in the film may be random. This means that the surface of diamond the highest points could be a mixture of (100), (111), (110) grains or grains of any orientation. After the reconditioning step, the texture of the surface roughness of diamond changes, at least 80 percent of the highest/tallest grains defined as the grains whose average heights lie within the distance between the peak value of the PV peak to 20% of the PV distance below the Peak value of the PV peak are represented by (111) grains or grains that are within 20 degrees tilt from the (111) orientation, after the conditioner reconditioning process.

Similarly, at least 50 percent of the shortest grains defined as the grains whose average heights lie within the distance represented by the valley position to 20% of the PV (peak-valley) distance from the valley value are represented by (100) or (110) grains or grains that are within 20 degrees tilt from the (100)) or (110) orientations, after the reconditioning process. This phenomena is shown in scanned images derived from optical profilometry measurements shown FIGS. 7A, 7B, and 7C. The highest grains are less than 20 degrees such as less than 10 degrees, such as less than 5 degrees from the (111) orientation. The highest height grains which are within 20 degrees from the (111) orientation are at least 5 nm higher in average height (such as 10 nm or 100 nm or 1 micron higher) as compared to the lowest grains.

Such surface roughness texture in diamond films after the conditioner reconditioning step occurs because the grains which are within the 20 degrees from the (111) orientation have a lower polishing rate during the reconditioning step than the (100) and the (110) grains when the diamond film is polished by a slurry containing diamond particles (average particle size range 10 nm to 100 microns, diamond particle concentration 0.01 weight percent in the slurry to 20 weight percent, slurry pH 1 to 13 for aqueous slurries, diamond particles suspended in water or non water such as oil, glycerol or any other non-organic solvent, polishing plate, hard metal, ceramic or metal-ceramic composite, or polymeric pad. Such texture can be obtained for diamond polycrystalline films on both patterned and unpatterned conditioner substrates.

The average size of the diamond grains which are within 20 degrees from the (111) orientation can vary from 1 micron to 150 microns. The thickness of the polycrystalline diamond films can vary from 0.5 micron to 500 microns, the more desirable thickness is between 2 micron to 100 microns and even more desirable is between 5 microns and 100 microns.

There are several advantages for diamond CMP pad conditioners to have the tallest/highest grains having an orientation within 20 degrees from the (111) plane. It is recognized herein that the (111) planes in diamond have the lowest chemical reactivity and also possess the highest hardness. Thus, the surface of the polycrystalline diamond with the (111) grains being the tallest will be more stable for chemical and mechanical degradation from the CMP polishing step. Accordingly, the CMP process for polishing pad conditioning using a disclosed CMP pad conditioner having a polycrystalline diamond film is expected to have lesser time dependent variability, and the pad conditioner is expected to last longer when compared to a diamond-based pad conditioner having a random diamond orientation.

Disclosed methods also can create facet angles between 20 and 160 degrees among the protruded faces on the CMP pad conditioner surface when measured parallel to the surface.

EXAMPLES

Disclosed embodiments are further illustrated by the following specific Examples, which should not be construed as limiting the scope or content of this Disclosure in any way.

Example 1. A CMP pad conditioner having protruding diamond particles on a metal conditioner substrate 500 has one of its particles 501 thereon shown as the scanned image in FIG. 5A with a magnification of 20×. The surface of the CMP pad conditioner had been previously subjected to 900 minutes of CMP polishing during a conventional CMP manufacturing operation. In this example a hydrogen peroxide based-slurry containing 5% by weight colloidal silica with a pH of 3.0 was used to polish copper and tantalum wafer surfaces at a pressure of 5 psi and 1.2 m/sec or linear velocity. The diamond CMP pad conditioner was also exposed to the same slurry but at a lower pressure of 3 psi. The scanned image of the diamond particle 501 shown in FIG. 5A can be seen to have a blocky rounded surface. There are no faceted edges or corners observable. The average dimensions of the diamond protrusions on the diamond particle 501 measured by averaging the maximum and minimum dimension of the embedded diamond particles on the pad conditioner surface was 300 microns.

Figure 5A:
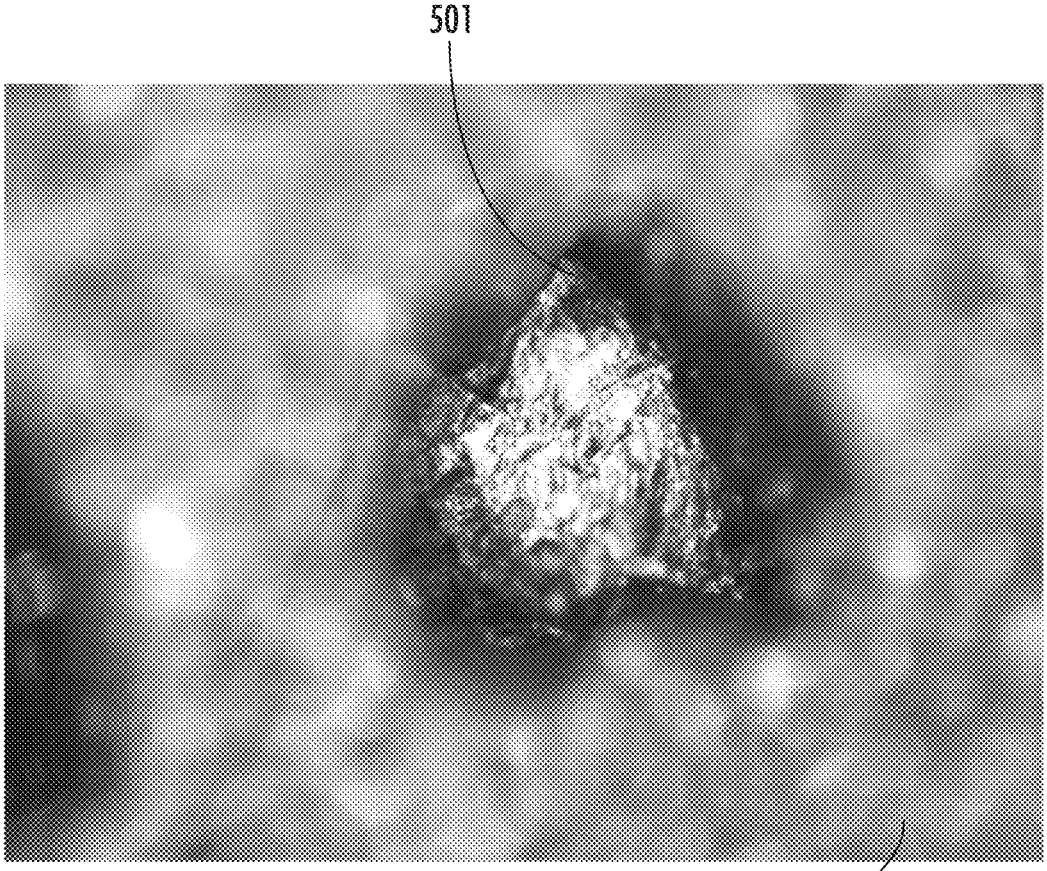
FIG. 5A (PRIOR ART)
FIG. 5A is a scanned image of one of the protruding diamond particles bonded on the surface of a CMP pad conditioner having a plurality of protruding diamond particles on a conditioner substrate before disclosed pad reconditioning, where there are no faceted edges or corners observable. (The magnification is 200×).
Figure 5B:
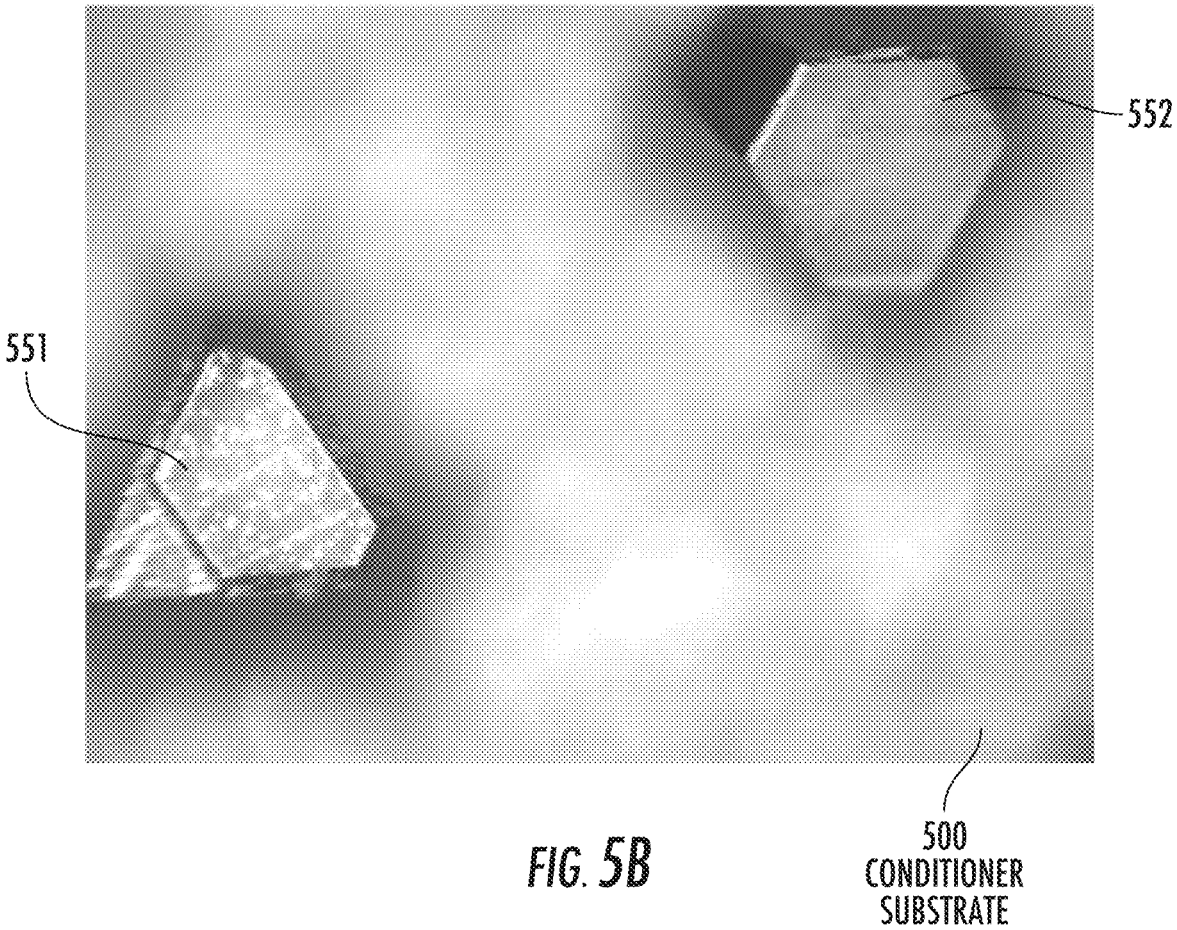
FIG. 5B is a scanned image of protruding diamond particles on the surface of a conditioner substrate after disclosed CMP pad conditioner reconditioning showing a flat faceted surface, where there are several faceted edges with their respective corners being observable. (The magnification is 200×), with 2 diamond particles being shown.

The pad conditioner shown in FIG. 5A in the conditioner reconditioning step was then polished on a Lapmaster CMP machine (from Lapmaster Wolters International LLC) with a nominal applied pressure of 2 psi and table speed of 30 rpms using a copper composite polishing pad. The copper composite pad comprised coated copper particles sintered to form a bulk platen on which a diamond slurry was squirted. Accordingly, in this case the copper platen acts as a pad during the conditioner reconditioning step. The slurry contained 2 wt. percent diamond particles with average size of 25 microns and the reconditioning time was 20 minutes. The flow rate of the slurry was 10 ml/min. The pH of the slurry was 5.0. The pressure during polishing the CMP pad conditioner was 3 psi, and the rotational speed of the platen was 20 rpm. FIG. 5B is a scanned image of two protruding diamond particles 551, 552 on the surface of the metal conditioner substrate 500 after disclosed CMP pad conditioner reconditioning that both show a flat faceted surface, where there are several faceted edges with their respective corners (edges) being observable. (magnification of 200×). Prior to reconditioning as described above shown in FIG. 5A for the particle 501 shown there were no faceted edges or corners observed. The particles 551, 552 on the conditioner substrate 500 now shown in FIG. 5B evidence faceted edges visible with their respective corners each observable. After the conditioner reconditioning step, the WIPF values were determined (using profilometry methods) to be less than 10 microns, and the PPF values when measured for 2 to 10 adjacent protrusions was determined to be less than 10 microns.

The CER between the horizontal and the vertical diamond particle surfaces was less than 10 microns measured at the facet corners between the vertical and the horizontal faces. The sharpest diamond protrusion points defined by the lowest CER value after the reconditioning step were confirmed to occur within 5 microns from edge of the protrusions for greater than 83 percent of the diamond grains when adjacent 6 protrusions were measured for several different protrusion configurations. The CER values after the CMP pad conditioner reconditioning step decreased by more than 50 percent compared to prior to the conditioner reconditioning step.

It is noted that a similar sharpening effect (lower CER value) can generally be obtained if the average diamond particle size in the polishing slurry is varied from 1 microns to 500 microns and the concentration of the diamond particles changes from 0.001 weight percent to 80 weight percent. As noted above the slurry may contain other hard particles besides diamond such as alumina, silica, or particles having a Vickers hardness less than 3,000 $Kg/mm^2$ or less having average sizes ranging from 20 nm to 500 microns such as 0.1 μm to 10 μm. In one embodiment the average size of the non-diamond slurry particles is at least 10%, such as 20% or 50% to 90%, less than the average size of the diamond particles. The concentration of the non-diamond particles can vary from 1% to 70 weight %. The viscosity of the slurry with diamond or diamond with secondary particles can vary from 1 centiPoise (cP) to 2000 cP. The viscosity can be increased by adding particle or organic solvents such as glycerin, starch, glycerol and carbopol or other carbon containing compounds. The diamond slurry can also include organic solvents such as oil, or non-organic compounds with a molecular weight less than 1,000. The average size of the non-diamond particles can vary from 10 nm to 10 microns, such as between 100 nm and 5 microns. As described above, the polishing pads used in the reconditioning step can comprise metals, metal alloys, or ceramics which are harder than pure copper or have a Vickers hardness greater than 50 $Kg/mm^2$.

It is noted that same roughness parameters and ranges is expected if the CMP pad conditioner is made of hard particles other than diamond with hardness >3,000 $Kg/mm^2$ or the conditioner is fabricated by depositing a film of diamond or hard materials on a patterned substrate and reconditioned by the processing conditions shown in Example 1.

The reconditioned CMP pad conditioner was also found to provide a significantly reduced cut rate for the polishing pad from CMP. The cut rate of a CMP polishing pad is defined as the rate at which a polyurethane-based polishing pad (such as an IC 1000 pad from Dow Chemical) is eroded by a continuous use of a CMP pad conditioner. The cut rate of an IC 1000 pad was found to decrease by 32% when using a disclosed CMP pad conditioner having diamond protrusions as compared to a non-conditioned diamond protrusion CMP pad conditioner. The slurry used for the polishing process for these experiments was a 15% colloidal-based silica slurry with particle size of 70 nm and at a pressure of 3 psi and linear velocity of 1.5 m/sec. The pH of the slurry was 9.5 and the substrate for CMP polishing was silica.

Figure 6A:
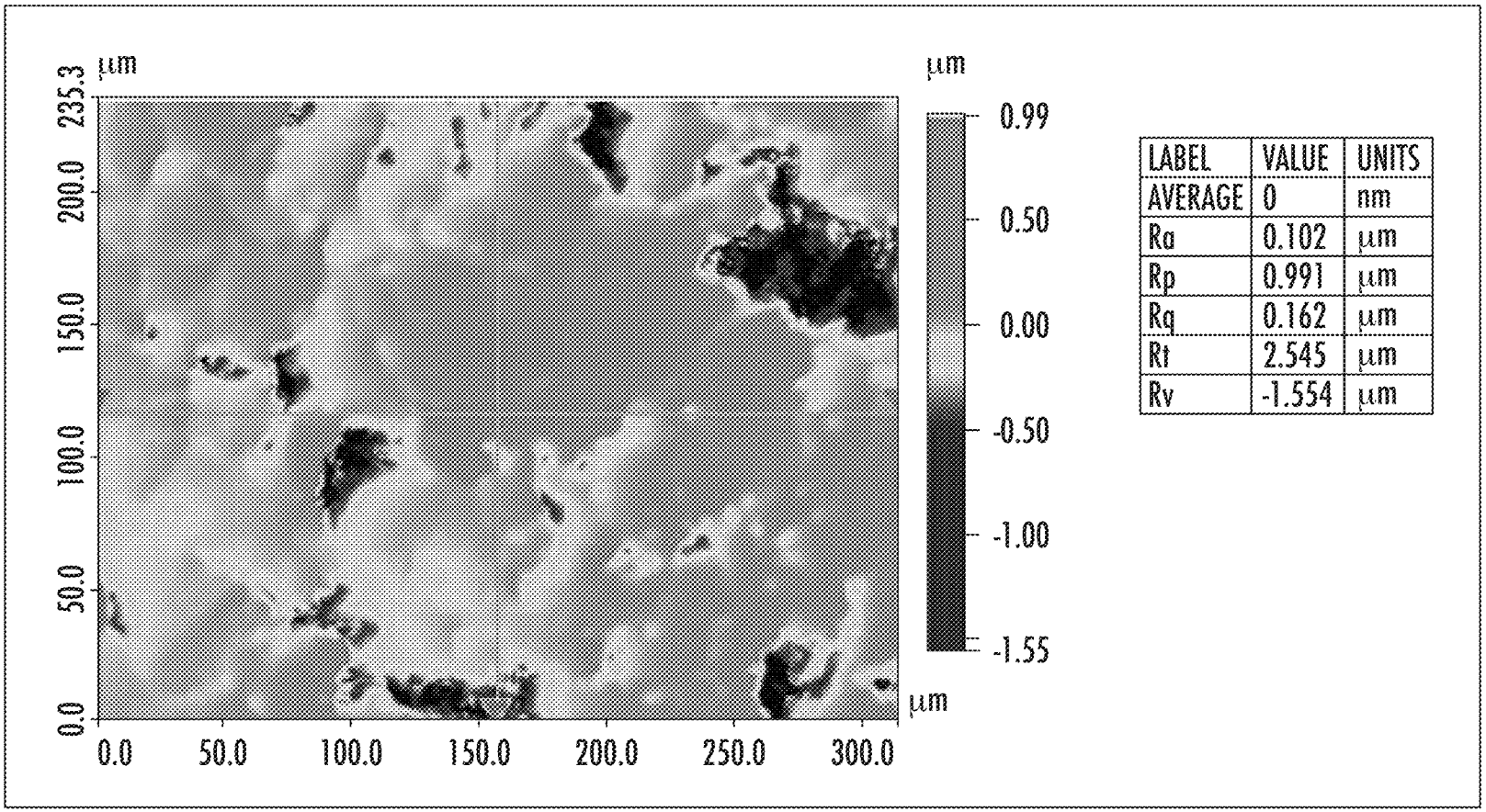
FIG. 6A shows a plot of optical profilometry derived surface roughness a diamond film of a CMP pad conditioner before disclosed polishing along with its roughness parameters, where Rt (difference in heights of the lowest and highest points) can be seen to be approximately 2.54 microns and Ra is approximately 100 nm.

Example 2. FIG. 6A shows a plot of optical profilometry derived surface roughness of a diamond film of a CMP pad conditioner before disclosed polishing along with its roughness parameters, where Rt can be seen to be approximately 2.54 microns, and Ra approximately 100 nm.

Figure 6B:
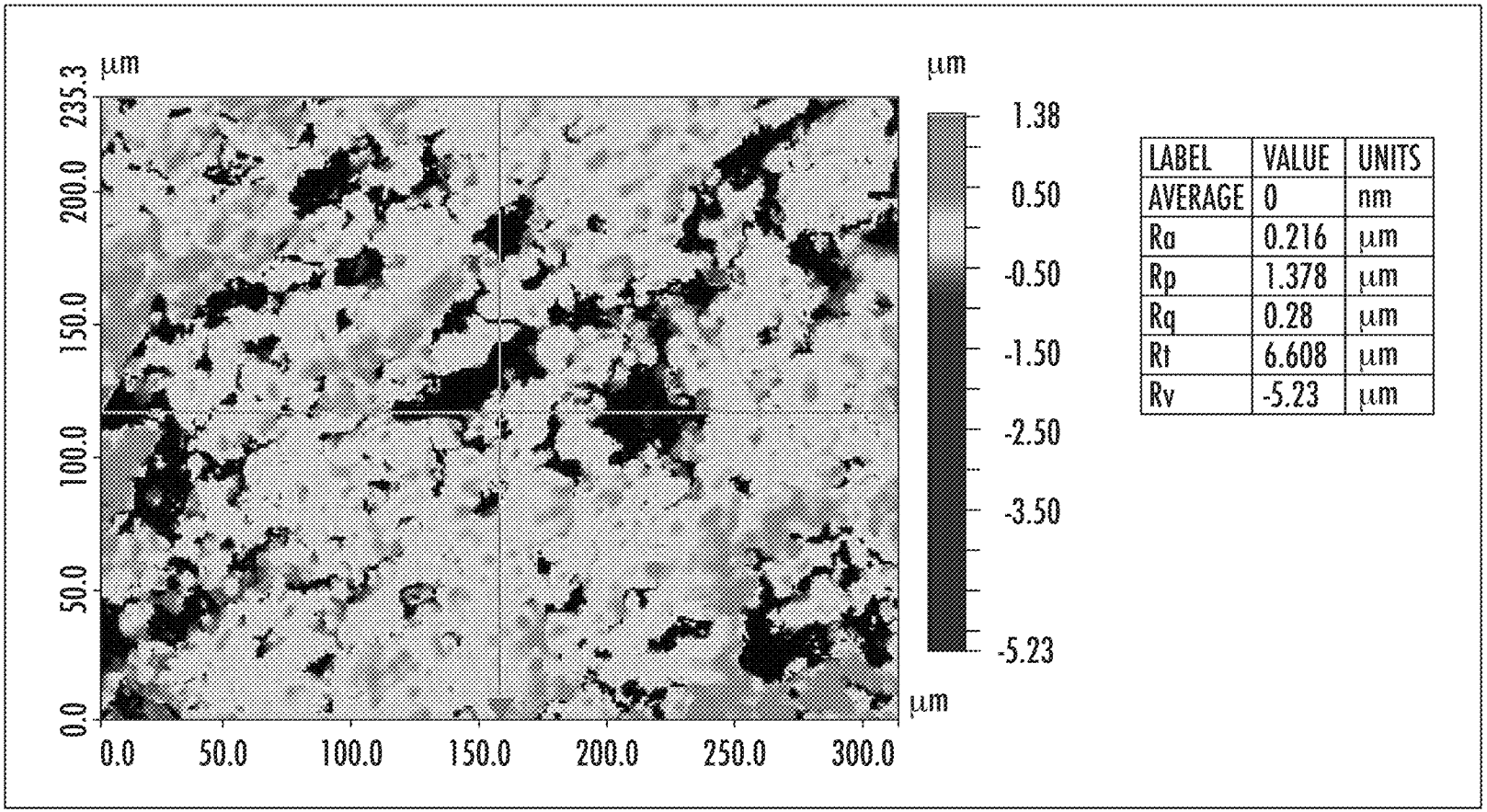
FIG. 6B shows the surface roughness of the flat surface after a disclosed CMP pad conditioner reconditioning process which shows that the surface roughness has a Ra value of 0.22 microns and the PV height of roughness of 6 microns.

The surface roughness of the flat surface after a disclosed CMP pad conditioner reconditioning process using a slurry of 2 percent 20 micron diamond particles and a copper pad is shown in FIG. 6B. FIG. 6B shows that the surface roughness has a Ra value of about 0.22 microns and the PV height of roughness of 6 microns. This roughness of the diamond protrusions will depend on the size of the abrasive diamond particles. The Ra value of the diamond protrusions can vary from 120 nm to 10 microns and the PV heights can vary from 1 micron to 60 microns.

Figure 7A:
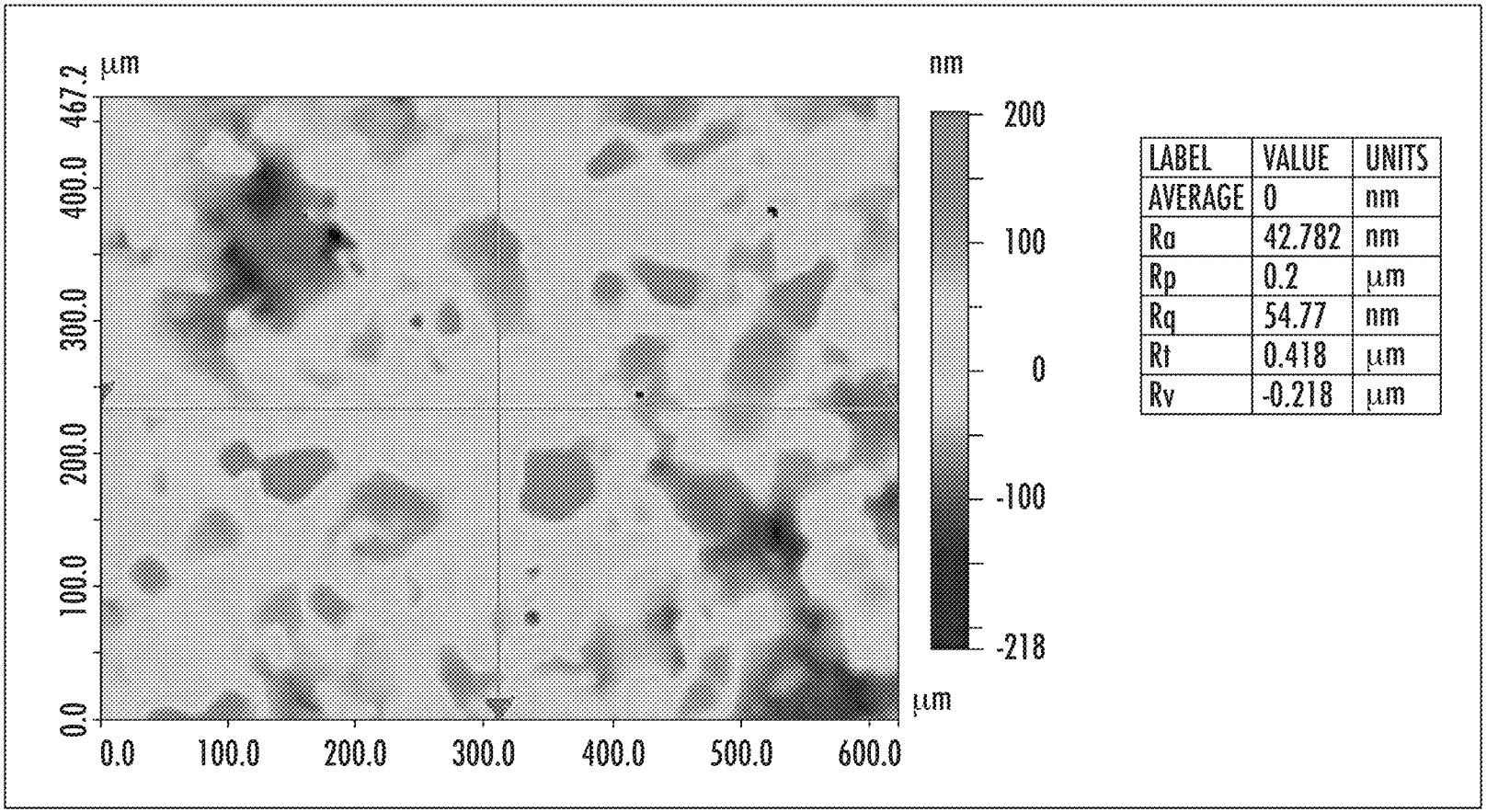
FIG. 7A shows a scanned white light 2-dimensional (2D) interferometry obtained image of a different thickness diamond film on a disclosed patterned conditioner substrate after a disclosed conditioner reconditioning step. The thickness the diamond film is 100 micron after it has been polished.
Figure 7B:
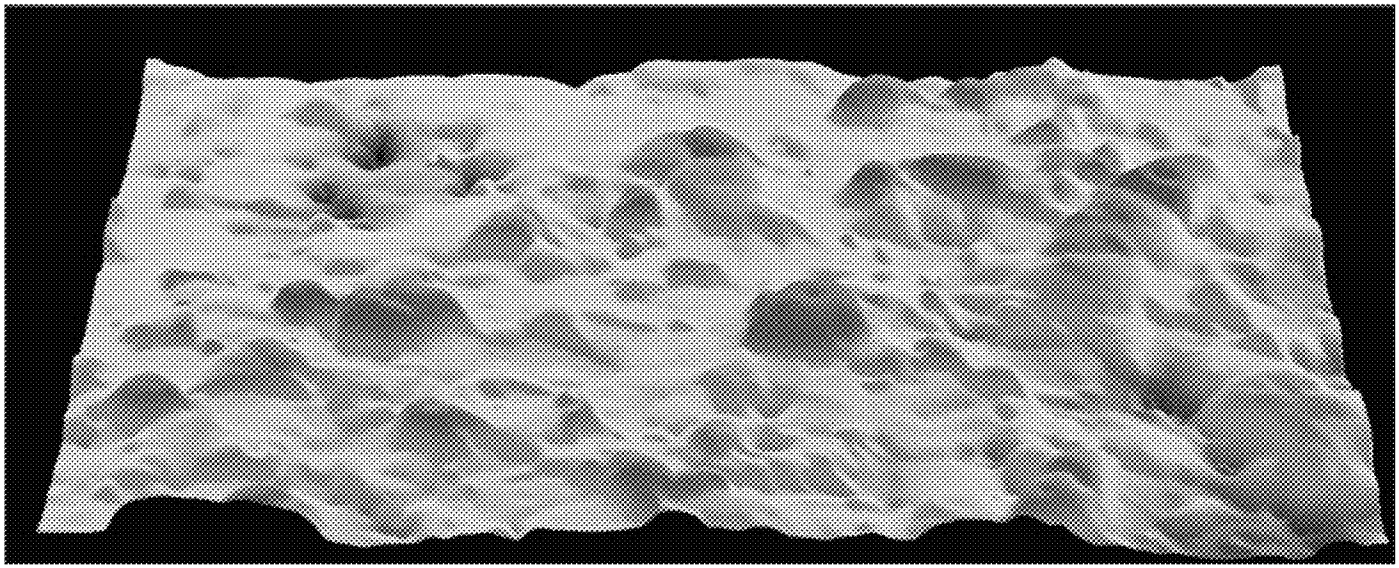
FIG. 7B shows a scanned white light 3D interferometry obtained image of the same film.
Figure 7C:
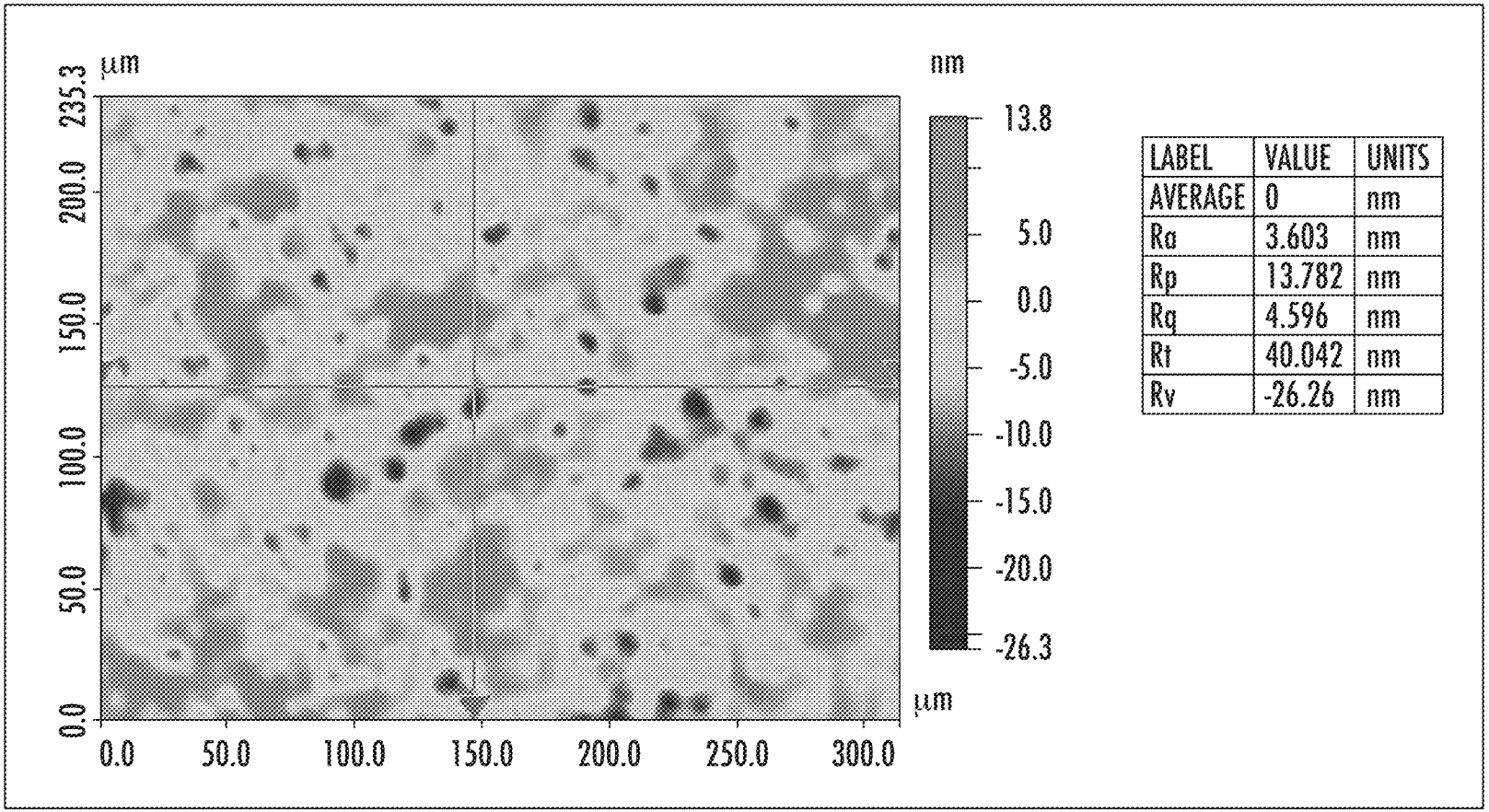
FIG. 7C show a scanned 2D optical profilometry obtained image of a 30 micron diamond film.

FIG. 7A shows a scanned white light 2D profilometry obtained image of a different thickness diamond film on a disclosed patterned conditioner substrate after it has been reconditioned with a slurry containing 1% diamond particles with average particle size of 100 nm and using a copper composite pad. The thickness the diamond film was 100 micron after it has reconditioned using a 1% diamond slurry with average diamond particle size of 100 nm. FIG. 7B shows a scanned white light 3D profilometry obtained image of the same film. FIG. 7C show a scanned 2D optical profilometry obtained image of a 30 micron diamond film.

While various embodiments of the invention have been described above, it should be understood that they have been presented by way of example only, and not limitation. Numerous changes to the disclosed embodiments can be made in accordance with this Disclosure without departing from the spirit or scope of the subject matter disclosed herein. Thus, the breadth and scope of this Disclosure should not be limited by any of the above described embodiments. Rather, the scope of this Disclosure should be defined in accordance with the following claims and their equivalents.

The invention claimed is:

1. A method of processing a chemical mechanical polishing (CMP) pad conditioner, comprising:

providing said CMP pad conditioner comprising a conditioner substrate including a metal, ceramic or a metal-ceramic material having a patterned surface with a polycrystalline diamond film thereon, and a slurry including an aqueous medium and a plurality of hard slurry particles having a Vickers hardness greater than 3,000 $Kg/mm^2$, and polishing said polycrystalline diamond film in a CMP apparatus using a polishing pad and the slurry, wherein said polycrystalline diamond film after said polishing includes tallest grains having a height lying in a top 20 percent of a peak-valley range, with at least 80 percent of said tallest grains having an orientation within 20 degrees from a (111) orientation.

2. The method of claim 1, wherein said plurality of hard slurry particles comprise diamond particles.

3. The method of claim 2, when an average size of said diamond particles range from 10 micron to 200 microns.

4. The method of claim 2, wherein a concentration of said diamond particles in said slurry is between 1% and 20% by weight.

5. The method of claim 1, wherein said polishing pad comprises a metal or a ceramic material with a Vickers hardness greater than 50 $kg/m^2$.

6. The method of claim 1, wherein said polishing pad comprises copper, steel, or a metal alloy including at least two metals.

7. The method in claim 1, when a viscosity of said slurry ranges from 2 centipoise to 1,500 centipoise.

8. The method of claim 2, further comprising secondary particles selected from alumina, or silica, with a Vickers hardness less than 3,000 $Kg/mm^2$ with a size between 10 nm to 10 micron, and a concentration between 1% to 60 weight percent.

9. The method of claim 8, wherein said plurality of hard slurry particles comprise diamond particles, and wherein a size of said secondary particles is at least 30 percent smaller than a size of said diamond particles.

* * * * *